US008850631B2

(12) United States Patent
Stekloff

(10) Patent No.: US 8,850,631 B2
(45) Date of Patent: Oct. 7, 2014

(54) BEDPAN HAVING A TAPERED INTERIOR

(76) Inventor: Debra S. Stekloff, Sarasota, FL (US)

( * ) Notice: Subject to any disclaimer, the term of this patent is extended or adjusted under 35 U.S.C. 154(b) by 997 days.

(21) Appl. No.: 12/927,446

(22) Filed: Nov. 15, 2010

(65) Prior Publication Data

US 2011/0113544 A1 May 19, 2011

Related U.S. Application Data

(60) Provisional application No. 61/281,413, filed on Nov. 17, 2009, provisional application No. 61/337,577, filed on Feb. 8, 2010.

(51) Int. Cl.
*A61G 9/00* (2006.01)

(52) U.S. Cl.
USPC ..... 4/455

(58) Field of Classification Search
CPC ..... A61G 9/00; A61G 9/003
USPC ..... 4/450, 452, 455, 456
See application file for complete search history.

(56) References Cited

U.S. PATENT DOCUMENTS

| | | | | |
|---|---|---|---|---|
| 481,375 | A * | 8/1892 | Smith | 4/455 |
| 1,006,653 | A * | 10/1911 | Hanly | 4/455 |
| 3,174,159 | A * | 3/1965 | Bertoldo | 4/455 |
| 4,117,845 | A | 10/1978 | Brown | |
| 4,270,231 | A | 6/1981 | Zint | |
| 6,189,162 | B1 | 2/2001 | Tanner | |
| 6,543,064 | B1 | 4/2003 | Prall et al. | |
| 6,904,621 | B2 | 6/2005 | Otto et al. | |
| 2006/0253968 | A1 * | 11/2006 | Mosler et al. | 4/450 |
| 2008/0083060 | A1 | 4/2008 | Beers et al. | |

* cited by examiner

*Primary Examiner* — Huyen Le
(74) *Attorney, Agent, or Firm* — David H. Chebvitz

(57) ABSTRACT

A bedpan for evacuating liquid stored therein is disclosed in which the bedpan comprises a housing having an interior portion, a side portion, a top portion, and a bottom portion, a drain opening formed in the housing along the side portion to allow body fluid to flow out of the interior portion, a tapered portion formed in the bottom portion to direct body fluid toward the drain opening, and a ledge portion formed in the side portion.

20 Claims, 8 Drawing Sheets

BEDPAN HAVING A TAPERED INTERIOR

RELATED APPLICATION

This application claims priority to U.S. Provisional Patent Application Ser. No. 61/281,413, filed on Nov. 17, 2009, and U.S. Provisional Patent Application Ser. No. 61/337,577, filed on Feb. 8, 2010, the disclosures of which are incorporated herein by reference.

BACKGROUND

This disclosure relates to a device for the collection and removal of liquid human waste and more particularly to a bedpan having a tapered interior for evacuating liquid waste from the bedpan at a fast rate.

Bedpans are used by bed-ridden individuals who are not capable of using toilet facilities. The bedpan is used to collect urine from an individual. When an individual has completed the discharge of liquid waste into the bedpan a healthcare provider or other individual will remove the bedpan and discard the contents. Problems occur when the bedpan is filled with urine and removed from under the patient. Frequently the urine splashes onto the bed and the patient. Bed linens need to be changed which is time consuming, costly, and causes the patient discomfort. If the patient has had back surgery and the dressing is moistened by the urine an infection may occur. In addition, patients whose skin is repeatedly exposed to urine in this manner and not cleaned and dried appropriately can obtain bedsores. Further problems, diseases, or complications may result from extended exposure of the skin to liquid waste stored in the bedpan.

There are known bedpans that have drains to facilitate the flow of urine from the bedpan into a collection device. However, such bedpans do not quickly or completely evacuate urine from the bedpan. These known bedpans have flat bottoms which do not adequately drain liquid from the interior of the bedpan. Such bedpans allow body fluid to pool in the bedpan that can contact the skin of the individual before the bedpan can be adequately drained. In view of this, such bedpans having a drain can still hold urine that will be in contact with the skin of the patient.

Therefore, it would be desirable to have a bedpan that would allow for the quick evacuation of body fluids or liquid waste contained within the bedpan. It is also desirable to provide a bedpan that directs body fluids toward a drain to be collected by a collection device or bag in a reliable and simplistic manner.

BRIEF SUMMARY

In one form of the present disclosure, a bedpan comprises a housing having an interior portion, a side portion, a top portion, and a bottom portion, a drain opening formed in the housing along the side portion to allow body fluid to flow out of the interior portion, a tapered portion formed in the bottom portion to direct body fluid toward the drain opening, and a ledge portion formed in the side portion.

In another form of the present disclosure, a bedpan comprises a housing having an interior portion, a side portion having a front side and a backside, a top portion, and a bottom portion, a drain opening formed in the interior portion to allow body fluid to flow out of the interior portion, a spout formed along the front side of the side portion and in fluid communication with the drain opening, a contoured portion formed in the bottom portion of the interior portion to direct body fluid toward the drain opening, and a ledge portion formed in the front side of the side portion.

In light of the foregoing comments, it will be recognized that the present disclosure provides a bedpan that quickly directs liquid waste to a drain and away from the skin of an individual and can be stacked or nested together for easy storage or packaging.

The present disclosure provides a bedpan that is of simple construction and design and which can be easily employed with highly reliable results.

The present disclosure provides a bedpan that can be easily carried, stored, or cleaned by a healthcare provider or other individual.

The present disclosure provides a bedpan that can be constructed or assembled using common and inexpensive materials.

The present disclosure provides a bedpan having a tapered or contoured interior or bottom that directs liquid out of the interior of the bedpan through a drain.

The present disclosure provides a bedpan that is of unitary construction for easy transportation, installation, use, and cleaning.

DETAILED DESCRIPTION OF PREFERRED EMBODIMENTS

Figure 1:
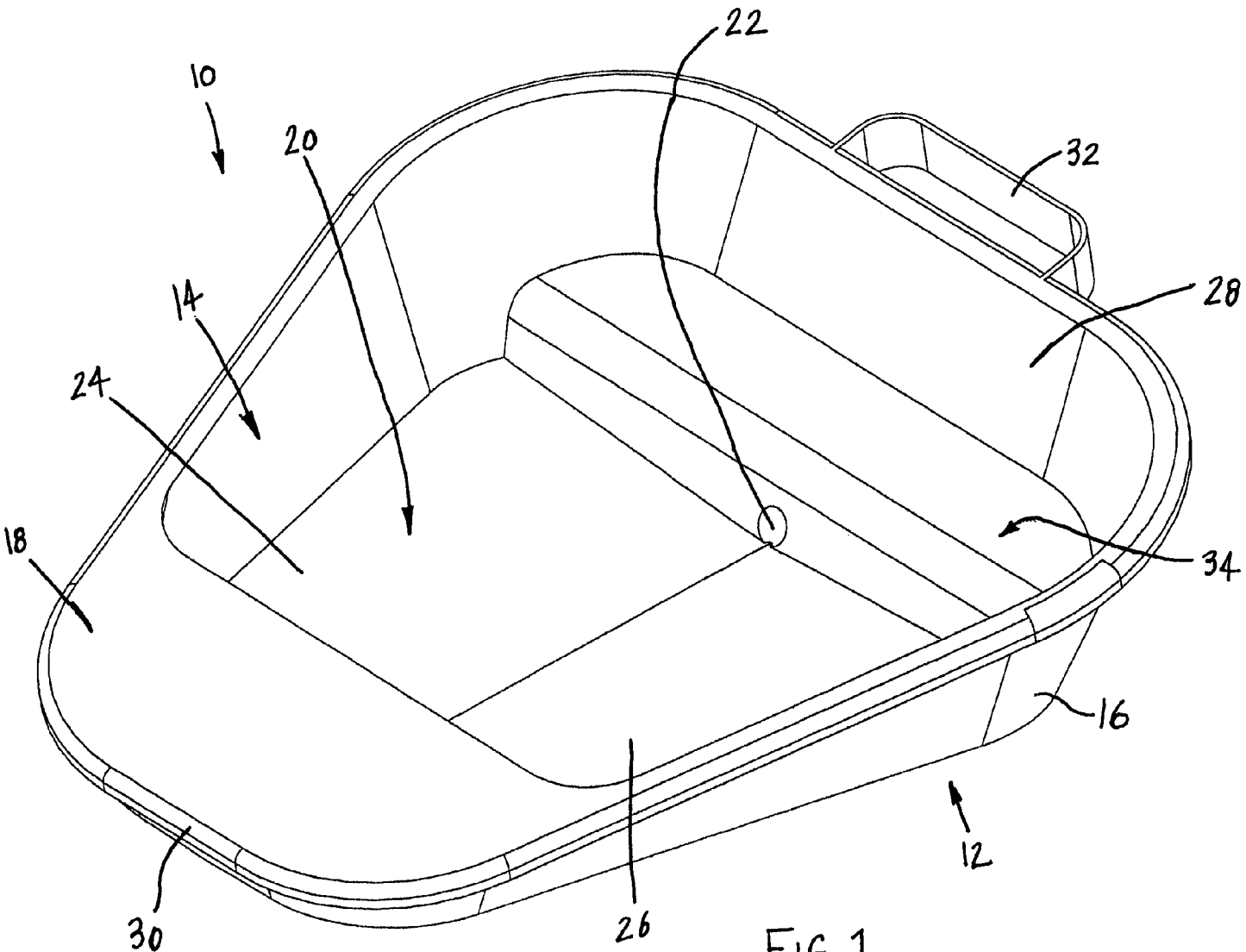
FIG. 1 is a perspective view of a bedpan constructed according to the present disclosure.

Referring now to the drawings, wherein like numbers refer to like items, number 10 identifies a preferred embodiment of a bedpan constructed according to the present disclosure. With reference now to FIG. 1, the bedpan 10 comprises a hollow housing 12 having an interior portion 14, a side portion 16, a top portion 18, and a bottom portion 20. A drain opening 22 is formed in the housing 12 along the side portion 16 to allow body fluid to flow out of the interior portion 14 to a receiving bag or container (not shown), as will be explained more fully herein. The bottom portion 20 comprises a first tapered portion 24 and a second tapered portion 26. The tapered portions 24 and 26 are used to direct any urine or body waste toward the drain opening 22 and are angled toward the drain opening 22. The tapered portions 24 and 26 act as a funnel, trough, or an angled trough to quickly direct any body liquid toward the drain opening 22 so that the body liquid is not allowed to pool or settle near the exposed skin of a user of the bedpan 10. In essence, the tapered portions 24 and 26 are angled or contoured such that any body liquid or waste in the interior portion 14 will flow or be directed toward the drain opening 22 for removal through the drain opening 22. Although the tapered portions 24 and 26 are shown as two separate portions it is contemplated that there may be one tapered or contoured portion within the interior portion 14. The side portion 16 has a front side 28 and a backside 30. The front side 28 is a larger or higher profile than the backside 30. This allows the bedpan 10 to be easily positioned underneath a patient by a healthcare provider. However, it is possible that the bedpan 10 may have a substantially uniform profile in that the front side 28 would be the same size or height as the backside 30. A handle 32 may be provided on the front side 28 of the side portion 16 to facilitate removal or insertion of the bedpan 10. The bedpan 10 also has a ledge or step portion 34 positioned on front side 28 in the interior portion 14. The ledge portion 34 is used to direct urine toward the drain opening 22. The ledge portion 34 also facilitates stacking or nesting of the bedpan 10, as will be described in more detail herein. The ledge portion 34 also reduces the volume of the interior portion 14 so that less fluid or urine is allowed to remain in the bedpan 10.

Figure 2:
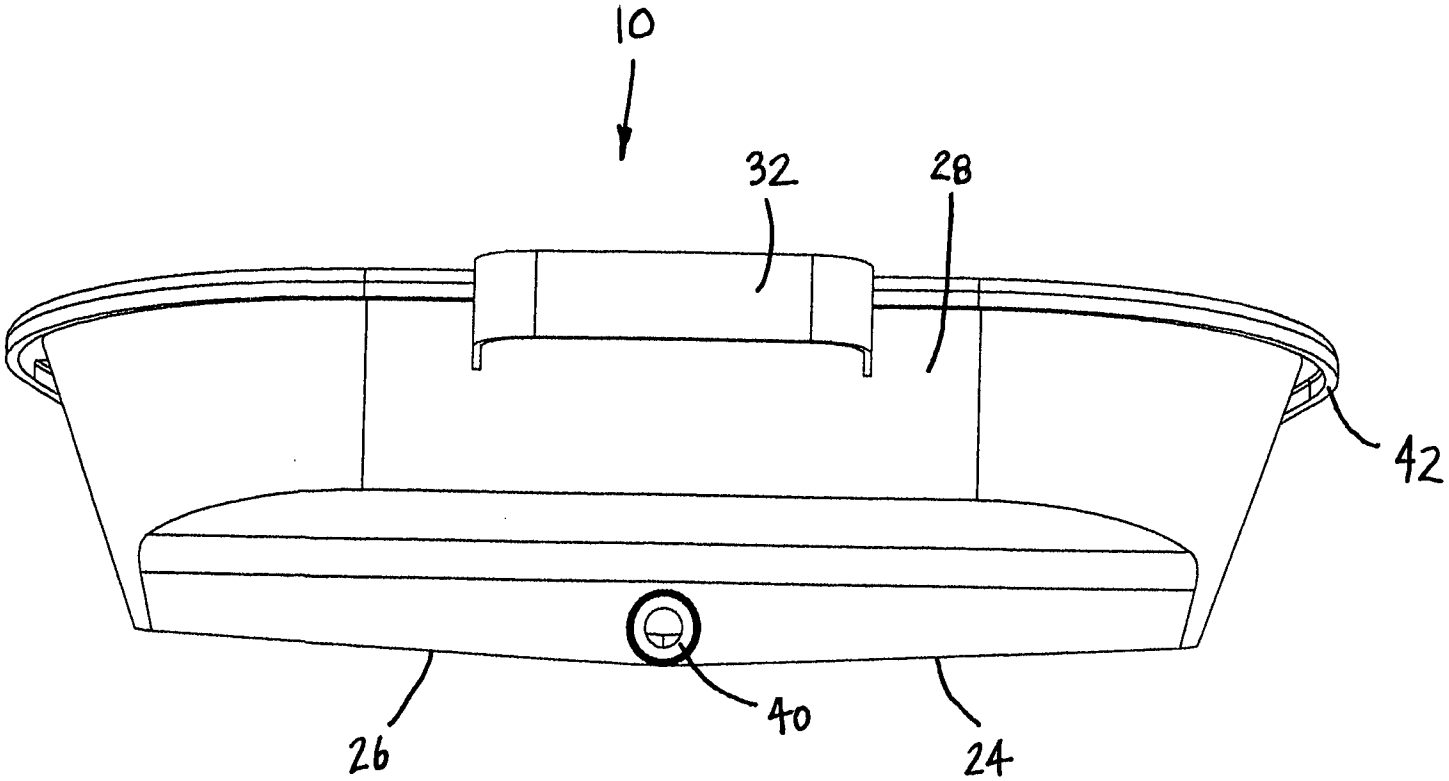
FIG. 2 is a front view of the bedpan shown in FIG. 2.

FIG. 2 is a front view of the bedpan 10. The bedpan 10 is shown having a drain spout or output port 40 extending out from the front side 28. The spout 40 is adapted to be connected to a tube, a flexible tube, or other tubing or conduit, all of which are not shown which can direct urine or fluid out of the bedpan 10. The spout 40 is in fluid communication with the drain opening 22. The tapered portions 24 and 26, which form a V-shaped bottom, are used to direct or guide liquid waste to the drain opening 22 and out through the spout 40. Although not shown, it is possible and contemplated to include a cap to close the port 40 when not in use or when transporting the bedpan 10. Further, the drain spout 40 may be configured having a tapered ribbed structure, as will be detailed further herein or the drain spout 40 may take on various other configurations as will be explained herein. The bedpan 10 is also shown having the handle 32 extending away from the front side 28. The bedpan 10 may also have a peripheral lip 42 that extends along the entire periphery of the bedpan 10. The lip 42 may be used to easily grasp the bedpan 10.

Figure 3:
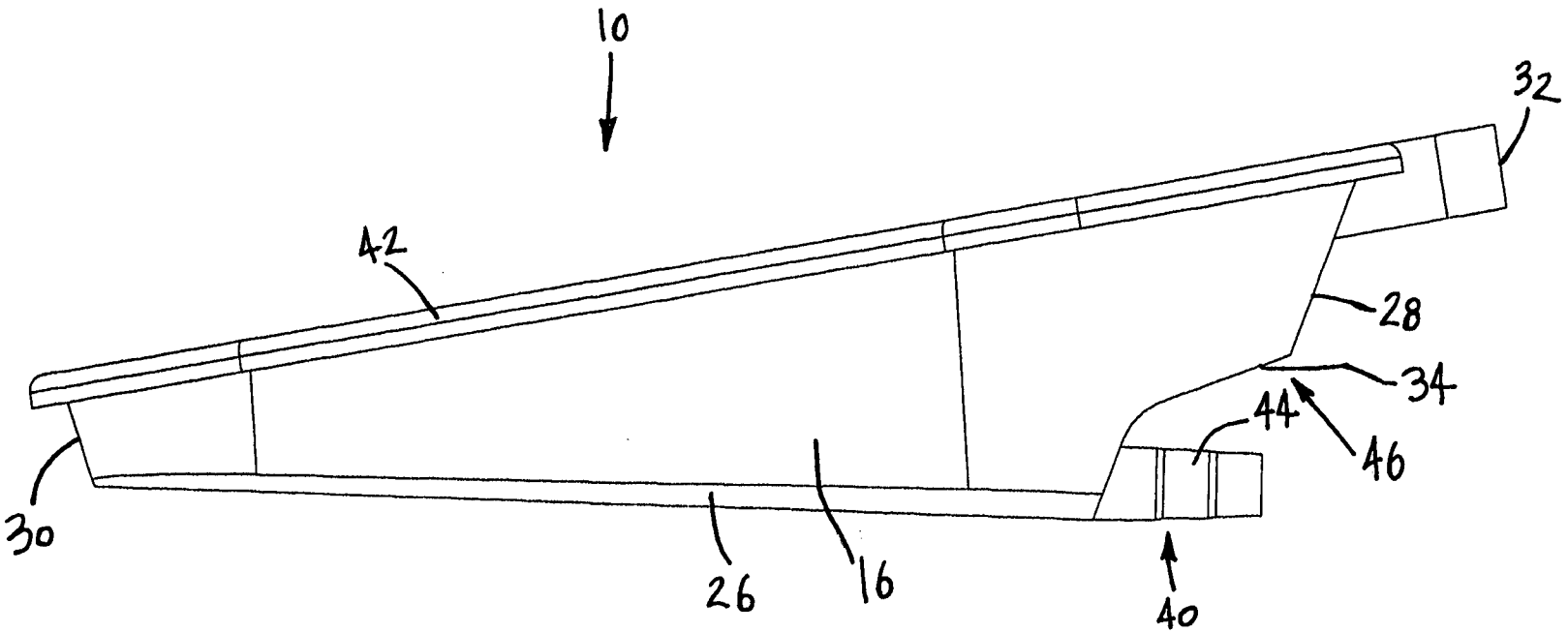
FIG. 3 is a side view of the bedpan shown in FIG. 2.

Turning now to FIG. 3, a side view of the bedpan 10 is depicted. The bedpan 10 is shown having the spout 40 extending out from the front side 28. The drain spout 40 is shown as being a tapered ribbed structure 44. This structure 44 allows a flexible tubing (not shown) to be inserted over the structure 44 to better hold and grasp the tubing. As will be explained, the tubing may be connected to a collection bag to collect urine that is funneled from the bedpan 10 through the drain opening 22 and the drain spout 40. The ledge portion 34 is a step like construction 46 that extends over the spout 40. The front side 28 has a larger height than the backside 30 and the front side 28 tapers down to the backside 30. The handle 32 is shown extending out from the front side 28. Also, the lip 42 extends along the entire perimeter of the bedpan 10.

Figure 4:
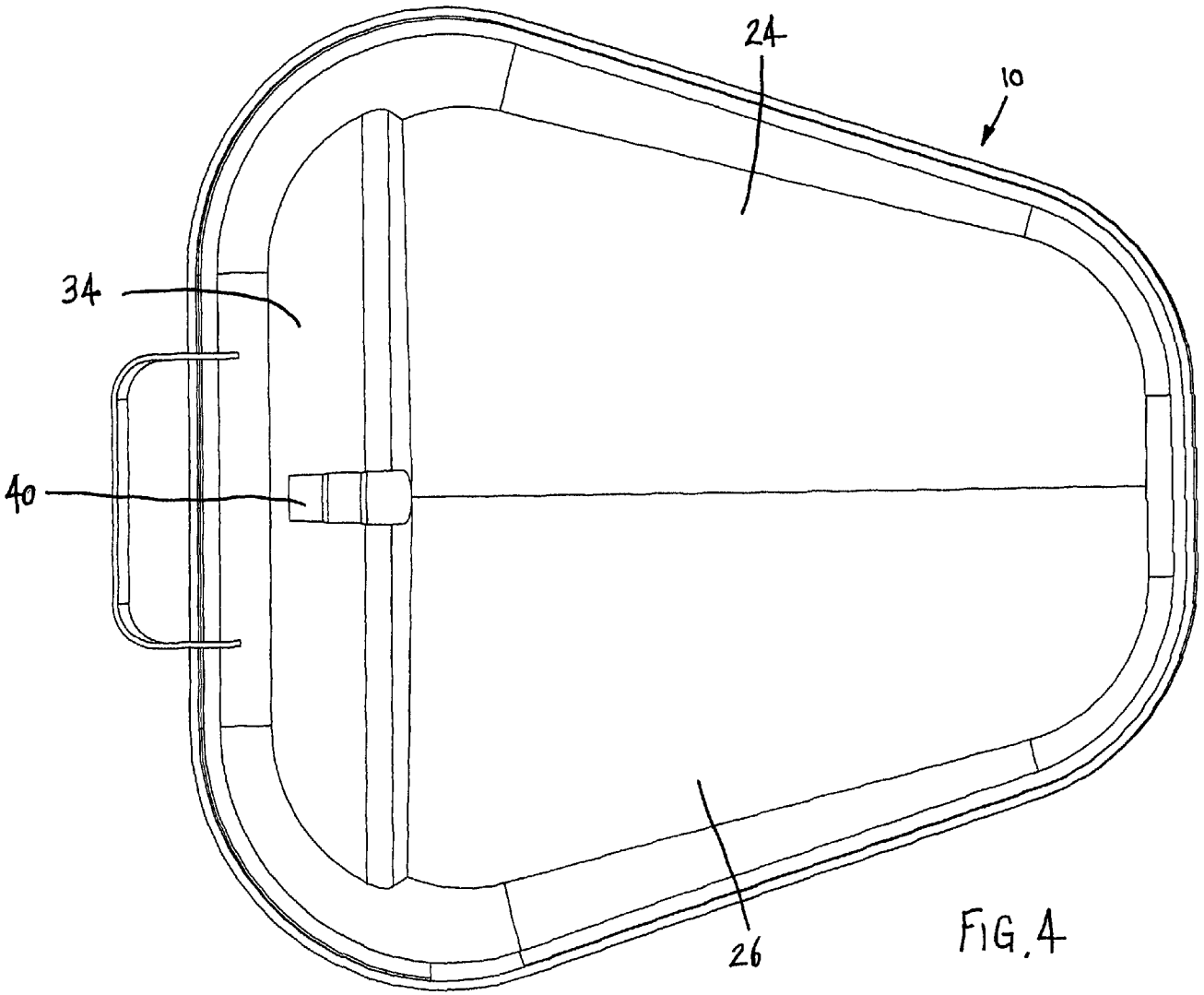
FIG. 4 is a bottom view of the bedpan shown in FIG. 2.

FIG. 4 illustrates a bottom view of the bedpan 10. The tapered portions 24 and 26 are shown being angled or V-shaped to facilitate drainage of liquid in the bedpan 10 to the spout 40. The ledge portion 34 extends out over the spout 40.

Figure 5:
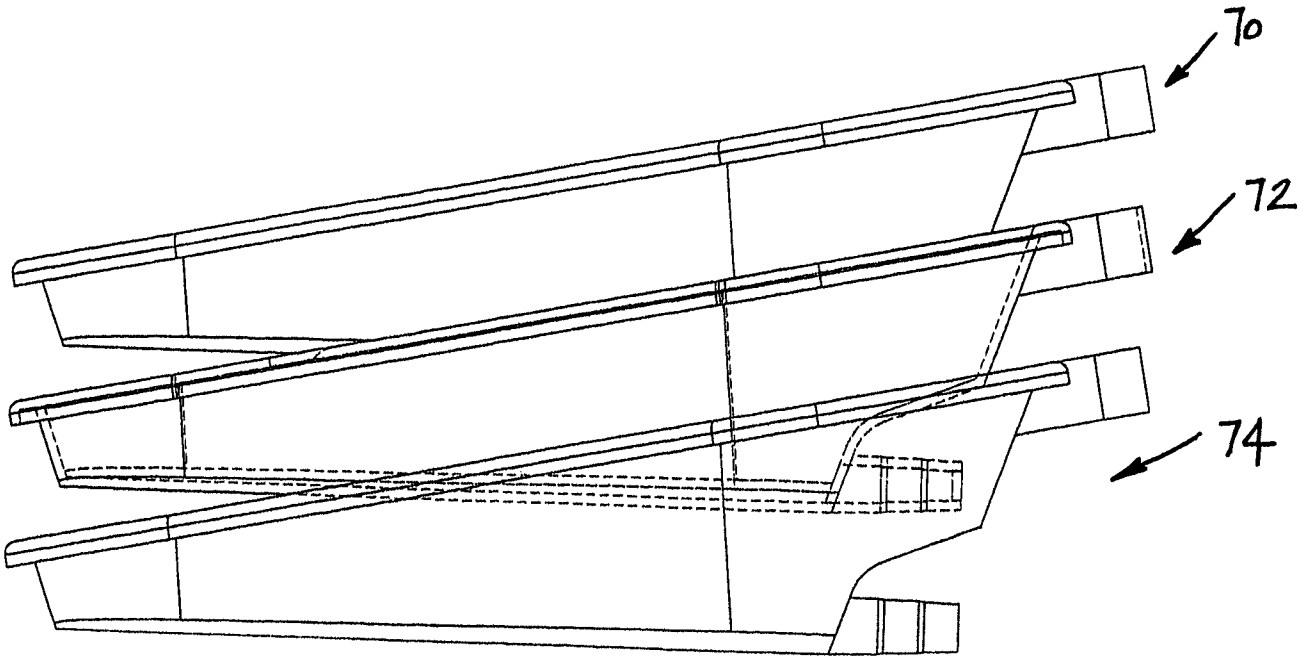
FIG. 5 is a side view of a few of the bedpans shown in a stacked configuration and one of the bedpans shown partially in phantom.

With reference now to FIG. 5, a first bedpan 70, which is substantially the same as the bedpan 10, is shown stacked on top a second bedpan 72 which is in turn stacked on top of a third bedpan 74. In this manner the bedpans 70, 72, and 74 can be transported or stored in a small space. It is also possible to have more than the three bedpans 70, 72, and 74 stacked or nested together. As can be appreciated, the ledge portion 34 of the bedpan 74 is used to capture the spout 40 of the bedpan 72 that is stacked above the bedpan 74. In the same manner, the ledge portion 34 of the bedpan 72 is able to capture the spout 40 of the bedpan 70. Again, in this manner numerous bedpans 10, 70, 72, or 74 may be stacked or nested together.

Figure 6:
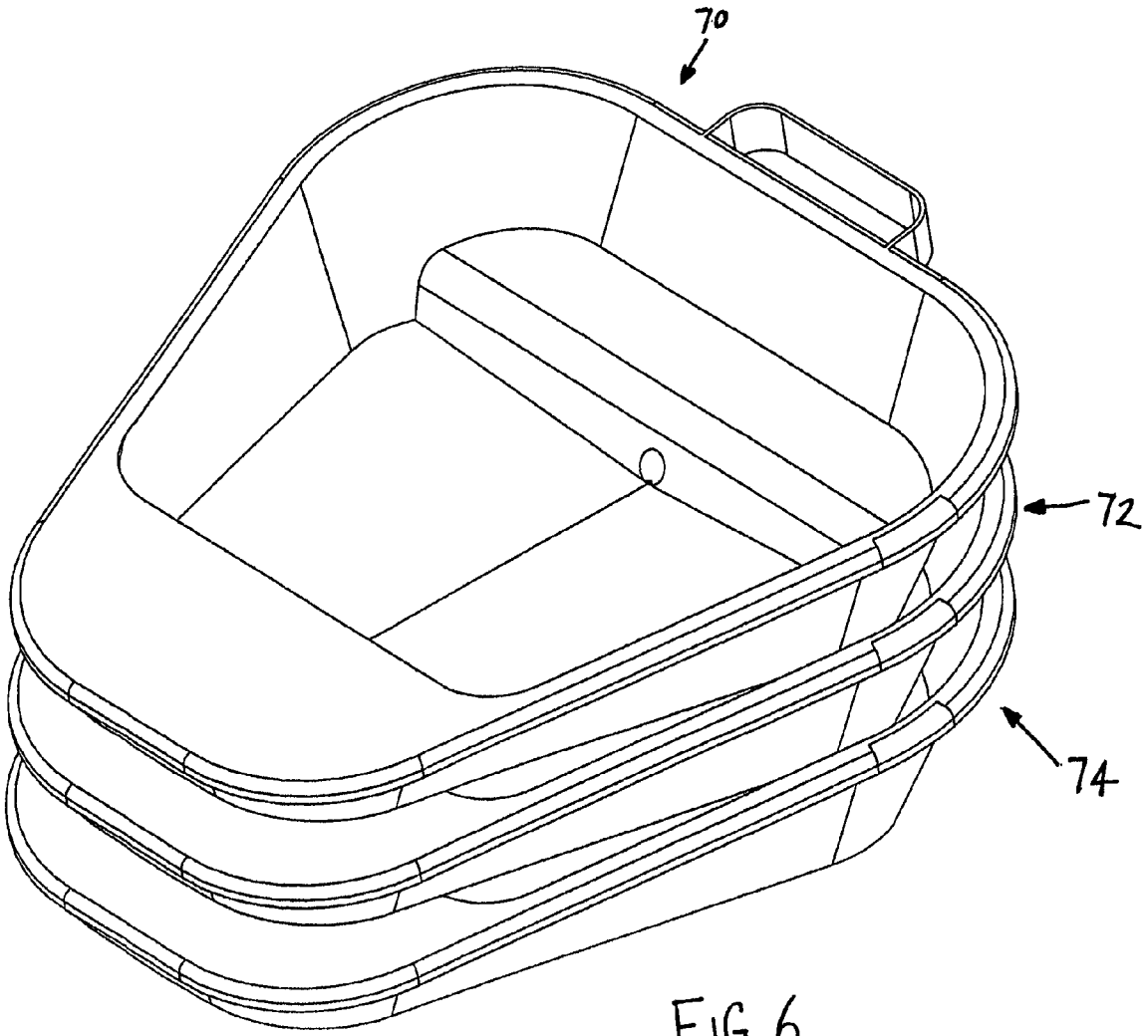
FIG. 6 is a perspective view of a few of the bedpans shown in a stacked configuration.

FIG. 6 depicts a perspective view of the bedpans 70, 72, and 74 nested together. The bedpan 70 is capable of being held or stacked in the bedpan 72 by placing the spout 40 into the ledge portion 34 of the bedpan 72.

Figure 7:
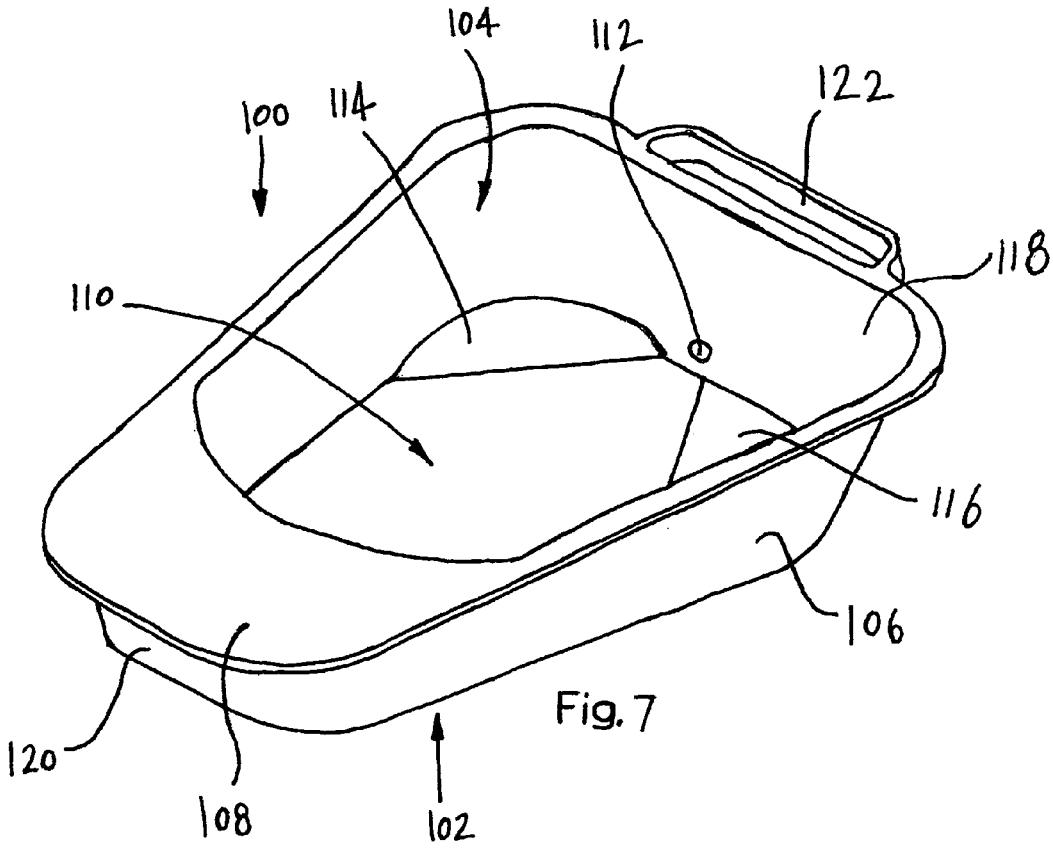
FIG. 7 is a perspective view of another preferred embodiment of a bedpan constructed according to the present disclosure.

With reference now to FIG. 7, another embodiment of a bedpan 100 is illustrated. The bedpan 100 is shown to comprise a hollow housing 102 having an interior portion 104, a side portion 106, a top portion 108, and a bottom portion 110. A drain opening 112 is formed in the housing 102 along the side portion 106 to allow body fluid to flow out of the interior portion 104 to a receiving bag or container (not shown), as will be explained in more detail herein. The bottom portion 110 comprises a first tapered portion 114 and a second tapered portion 116. The tapered portions 114 and 116 are used to direct any urine or body liquid toward the drain opening 112. The tapered portions 114 and 116 act as a trough or an angled trough to quickly direct any body liquid toward the drain opening 112 so that the body liquid is not allowed to pool or settle near the exposed skin of a user of the bedpan 100. In essence, the tapered portions 114 and 116 are angled or contoured such that any body liquid or waste in the interior portion 104 will flow or be directed toward the drain opening 112 for removal through the drain opening 112. It is also possible that the tapered portions 114 and 116 may extend up the side portion 106 to further direct any liquid toward the drain opening 112. Further, although the tapered portions 114 and 116 are shown as two separate portions it is contemplated that there may be one tapered portion within the interior portion 104. The side portion 106 has a front side 118 and a backside 120. The front side 118 is a larger or higher profile than the backside 120. This allows the bedpan 100 to be easily positioned underneath a patient by a healthcare provider. However, it is possible that the bedpan 100 may have a substantially uniform profile in that the front side 118 would be the same size or height as the backside 120. A handle 122 may be provided on the side portion 106 to facilitate removal or insertion of the bedpan 100.

Figure 8:
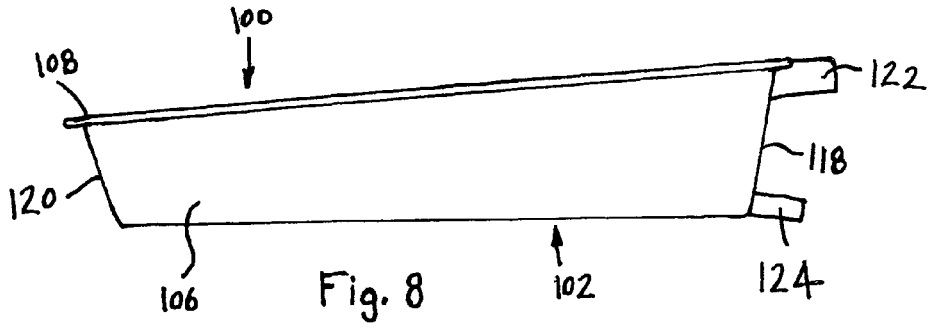
FIG. 8 is a side view of the bedpan constructed according to the present disclosure.

FIG. 8 illustrates a side view of the bedpan 100. The bedpan 100 has a drain spout or output port 124 extending out from the front side 118. The spout 124 is adapted to be connected to a tube (not shown). The spout 124 is in fluid communication with the drain opening 112. The tapered portions 114 and 116, as shown in FIG. 7, are used to direct or guide liquid waste to the drain opening 112 and out through the spout 124. Although not shown, it is possible and contemplated to include a cap to close the port 124 when not in use or when transporting the bedpan 100.

Figure 9:
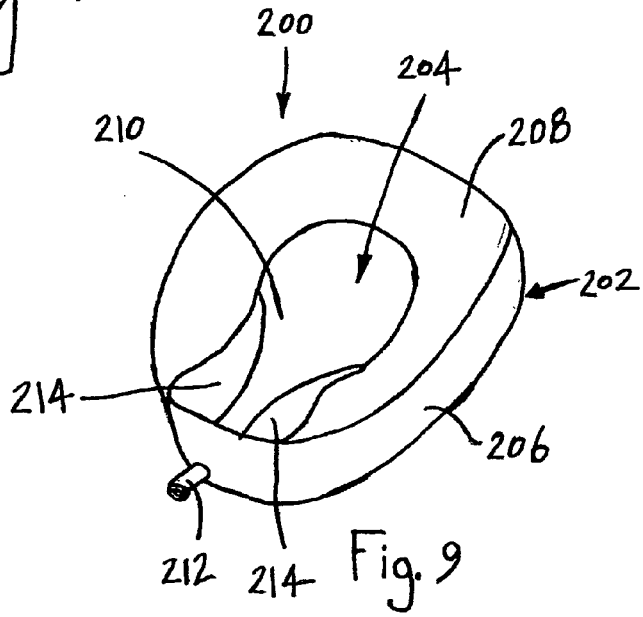
FIG. 9 is a perspective view of another embodiment of a bedpan constructed according to the present disclosure.

Referring now to FIG. 9, a perspective view of another embodiment of a bedpan 200 having a tapered interior or bottom is depicted. The bedpan 200 comprises a housing 202 having an interior portion 204, a side portion 206, a top portion 208, and a bottom portion 210. The side portion 206 has a drain spout 212 extending out from the side portion 206. The bottom portion 210 has a tapered or contoured portion 214 that is used to direct body fluid within the bedpan 200 toward the drain spout 212. Although not shown, it is possible and contemplated to include a cap to close the drain spout 212 when not in use or when transporting the bedpan 200.

Figure 10:
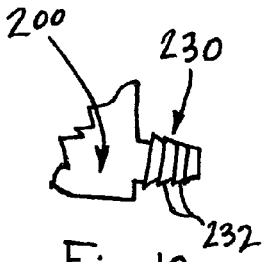
FIG. 10 is a partial view of an embodiment of a drain spout.

FIG. 10 depicts another embodiment of a drain spout 230 that can be formed as part of the bedpan 200. The drain spout 230 may have ribs 232 that are used for receiving drain hoses or tubing (not shown) of different sized diameters. The ribs 232 are contoured and the hose may be inserted onto the ribs 232. The ribs 232 also serve to seal a hose or a tube inserted onto the drain spout 230. It is also possible that the drain spout 230 may be used in conjunction with the bedpans 10, 70, 72, 74 or 100.

Figure 11:
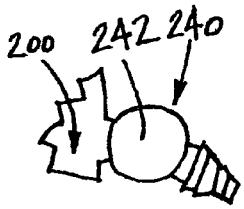
FIG. 11 is a partial view of another embodiment of a drain spout.

With reference to FIG. 11 another embodiment of a drain spout 240 is shown that may be formed as part of the bedpan 200. The drain spout 240 includes a hinged valve 242 that can be opened or closed. The drain spout 240 is shown in the open position and any fluid in the bedpan 200 may flow out of the drain spout 240. As can be appreciated, the drain spout 240 may be used in conjunction with the bedpans 10, 70, 72, or 74.

Figure 12:
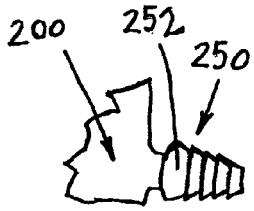
FIG. 12 is a partial view of another embodiment of a drain spout.

FIG. 12 illustrates another embodiment of a drain spout 250 that may be formed as part of the bedpan 200. The drain spout 250 is a push-pull type valve 252. Such a valve 252 is commonly found on soap or shampoo bottles. When the valve 252 is closed the spout 250 is pushed in and when the valve 252 is pulled out the spout 250 is opened and liquid within the bedpan 200 can flow out of the bedpan 200. It is also possible and contemplated that the valve 252 may be used in connection with the bedpans 10, 70, 72, or 74.

Figure 13:
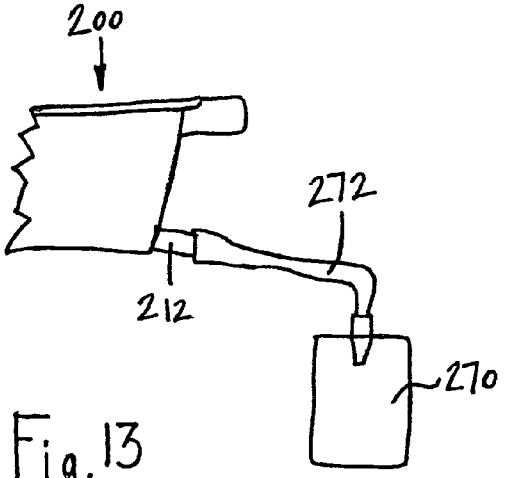
FIG. 13 is a partial view of a bedpan constructed according to the present disclosure connected to a collection bag.

With particular reference now to FIG. 13, the bedpan 200 is shown being connected to a waste collection bag 270. A flexible tubing 272 is connected to the spout 212 and then to the collection bag 270. The collection bag 270 may include markings to show how much fluid has been collected. A cap, not shown, may also be used in conjunction with the drain spouts 230, 240, and 250 to further prevent any liquid or waste exiting therefrom during transportation or use. Although not shown, but has been previously alluded to, the bedpan 10 may be connected to the collection bag 270 by attaching the tubing 272 to the drain spout 40 to allow liquid from the bedpan 10 to flow through the drain opening 22 and the drain spout 40 into the collection bag 270. Further, as can be anticipated, the bedpans 70, 72, 74, and 100 may also be connected to the collection bag 270 and the tubing 272.

As can be appreciated, the bedpans 10, 70, 72, 74, 100, and 200 may be constructed of any suitable material such as, by way of example only, plastic, polypropylene, acrylonitrile butadiene styrene (ABS), polyethylene terephthalate, polyvinyl chloride (PVC). It is also possible that the material may include or incorporate additives that inhibit bacteria growth or a germicide. It is also possible that the bedpans 10, 70, 72, 74, 100, and 200 may take on other shapes and sizes as the case may be. The bedpans 10, 70, 72, 74, 100, and 200 may include graphics and/or colors so as to be used with children.

From all that has been said, it will be clear that there has thus been shown and described herein a bedpan having a tapered interior. It will become apparent to those skilled in the art, however, that many changes, modifications, variations, and other uses and applications of the subject bedpan having a tapered interior are possible and contemplated. All changes, modifications, variations, and other uses and applications which do not depart from the spirit and scope of the disclosure are deemed to be covered by the disclosure, which is limited only by the claims which follow.

What is claimed is:

1. A bedpan comprising:

a housing having an interior portion, a side portion, a top portion, and a bottom portion;

a drain opening formed in the housing along the side portion to allow body fluid to flow out of the interior portion;

a tapered portion formed in the bottom portion to direct body fluid toward the drain opening; and a ledge portion formed in the side portion in a step configuration that extends over the drain opening.

2. The bedpan of claim 1 further comprising a drain spout in fluid communication with the drain opening.

3. The bedpan of claim 1 wherein the tapered portion comprises a first tapered portion and a second tapered portion.

4. The bedpan of claim 3 wherein the first tapered portion and the second tapered portion form a V-shape.

5. The bedpan of claim 1 further comprising a handle extending from the side portion.

6. The bedpan of claim 1 further comprising a drain spout in fluid communication with the drain opening, the drain spout having a ribbed configuration.

7. The bedpan of claim 1 further comprising a peripheral lip extending around the side portion.

8. The bedpan of claim 1 wherein the ledge portion extends into the interior portion.

9. A bedpan comprising:

a housing having an interior portion, a side portion, a top portion, and a bottom portion;

a drain opening formed in the housing along the side portion to allow body fluid to flow out of the interior portion;

a first tapered portion formed in the bottom portion and a second tapered portion formed in the bottom portion, the tapered portions adapted for directing body fluid toward the drain opening;

a spout portion extending out from the side portion and in fluid communication with the drain opening; and a ledge portion formed in the side portion in a step configuration extending over the spout portion and adapted to receive a spout portion of another bedpan.

10. The bedpan of claim 9 wherein the first tapered portion and the second tapered portion form a V-shaped bottom.

11. The bedpan of claim 9 wherein the spout portion has a ribbed configuration.

12. The bedpan of claim 9 wherein the ledge portion extends into the interior portion.

13. The bedpan of claim 9 further comprising a handle extending from the side portion and extending over the spout portion.

14. The bedpan of claim 9 further comprising a handle extending from the side portion.

15. The bedpan of claim 9 further comprising a peripheral lip extending around the side portion.

16. A bedpan comprising:

a housing having an interior portion, a side portion having a front side and a backside, a top portion, and a bottom portion;

a drain opening formed in the interior portion to allow body fluid to flow out of the interior portion;

a spout formed along the front side of the side portion and in fluid communication with the drain opening;

a contoured portion formed in the bottom portion of the interior portion to direct body fluid toward the drain opening; and a ledge portion formed in the front side of the side portion in a step configuration extending over the spout.

17. The bedpan of claim 16 wherein the contoured portion comprises a first tapered portion and a second tapered portion forming a V-shape.

18. The bedpan of claim 16 wherein the ledge portion extends into the interior portion.

19. The bedpan of claim 16 further comprising a handle extending from the front side of the side portion and extending over the spout.

20. The bedpan of claim 16 wherein the front side has a height and the backside has a height and the height of the front side is greater than the height of the backside.

* * * * *